US005937730A

United States Patent [19]

Nebel et al.

[11] Patent Number: 5,937,730

[45] Date of Patent: Aug. 17, 1999

[54] PNEUMATICALLY OPERABLE DRIVE UNIT WITH A TEMPERATURE DEPENDENT IRREVERSIBLY RELEASABLE LOCK JOINT

[75] Inventors: Eugen Nebel, Bruchkoebel; Walter Schneider, Wetzlar; Klaus Hoerschken, Elz, all of Germany

[73] Assignee: Samson Aktiengesellschaft, Frankfurt, Germany

[21] Appl. No.: 08/977,619

[22] Filed: Nov. 25, 1997

[30] Foreign Application Priority Data

Nov. 28, 1996 [DE] Germany ..... 196 49 440

[51] Int. Cl.[6] ..... F01B 25/26

[52] U.S. Cl. ..... 92/5 L; 92/15; 92/23; 92/130 R

[58] Field of Search ..... 92/5 L, 63, 130 R, 92/130 A, 131, 5 R, 135, 15, 23

[56] References Cited

U.S. PATENT DOCUMENTS

| | | | |
|---|---|---|---|
| 4,263,839 | 4/1981 | Akkerman et al. | 92/23 |
| 4,442,756 | 4/1984 | Goans | 92/23 |

OTHER PUBLICATIONS

"Messen, Steuern und Regeln in der Chemischen Technik" 3rd Edition vol. III, Springer–Verlag 1981, p. 190.

*Primary Examiner*—Thomas E. Denion
*Attorney, Agent, or Firm*—Evenson, McKeown, Edwards & Lenahan, P.L.L.C.

[57] ABSTRACT

A drive unit is designed as a diaphragm drive with return springs for shifting an associated actuator, connected by a diaphragm plate and a driving diaphragm, into a safety position. The drive unit also includes actuating springs that are held in a compressed state by two nested sleeve-shaped counterbearings that are locked during normal operation and located coaxially with respect to the return springs. The lock is formed by a temperature-dependent joint.

19 Claims, 1 Drawing Sheet

A

PNEUMATICALLY OPERABLE DRIVE UNIT WITH A TEMPERATURE DEPENDENT IRREVERSIBLY RELEASABLE LOCK JOINT

BACKGROUND OF THE INVENTION

1. Field of the Invention

This invention relates to a pneumatically operable drive unit with an energy storage mechanism for shifting an associated actuator into a safety position when the auxiliary energy supplying the driving force fails.

2. Description of Related Art

Pneumatic drive units of this type serve to produce lifting and turning movements of actuators for throttling flowing media; see "Messen, Steuern und Regeln in der Chemischen Technik," [Measurement, Control, and Regulation in Chemical Engineering], 3rd edition, Volume III, Springer-Verlag 1981, p. 190.

Such pneumatic drive units are characterized, in particular, by their simple, sturdy designs and by the high actuating speeds that they can reach. As a rule, pneumatic drive units are designed to be single-acting so that the pneumatic force can act in only one direction. The required restoring force is usually produced by compression springs provided in the drive unit. These springs guarantee the movement of the actuator into the above-mentioned safety position if the pneumatic system fails.

It is known that this safety position can also be used as a safety measure when a maximum temperature is exceeded, in the case of a fire for example, when the pneumatic lines for the drive unit are made from a plastic that cannot withstand heat.

In practice, such drive units fail when, for example, a container or boiler must be opened in case of fire in order to prevent an explosion. If the pneumatic system fails, then it is necessary to keep the container closed to avoid environmental impact.

Therefore, there is a need for a pneumatic drive unit by which the two different safety positions can be achieved when the pneumatic system fails and when a maximum temperature is exceeded.

SUMMARY OF THE INVENTION

The goal of the present invention is to improve on the known pneumatic drive unit by implementing two different safety positions, representing failure of the pneumatic system and exceeding of a maximum temperature, in a single actuator.

Hence, the invention produces a pneumatic drive unit having a single adjusting member in the form of a drive rod which can be moved into two different safety positions by two energy storage devices that act in different directions. Such energy storage devices may, for example, be in the form of compression springs that act as return and positioning springs.

The previously required second drive unit is eliminated. This results in savings in manufacture and maintenance.

The design of the second energy storage device according to the invention is especially advantageous since the joint formed of cylinder envelopes facing one another with a joint located therebetween forms an operationally reliable connection between the counterbearings that hold the second energy storage device under tension. The connection is likewise broken in an operationally reliable fashion when a maximum temperature, predetermined by the choice of the joint, is reached. The joint may, for example, be a solder alloy.

Adhesives can also be used at the joint for special applications. Such materials as acrylate, cyanoacrylate, epoxy resin, etc., may be used at the joint for securing the second energy storage device.

The invention will now be described with reference to an embodiment shown schematically in the drawing.

DESCRIPTION OF THE PREFERRED EMBODIMENT

Figure 1:
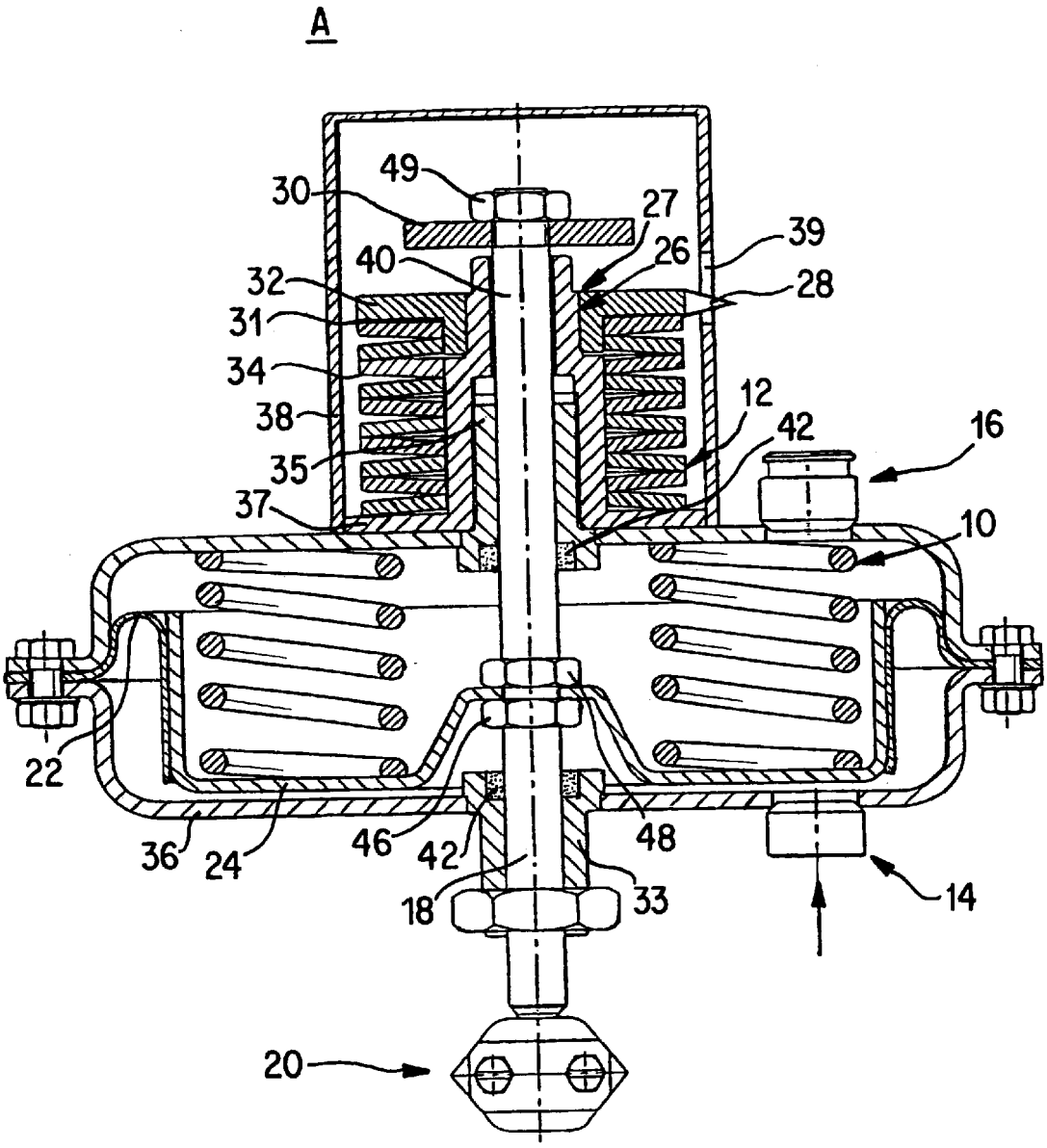
FIG. 1, the only drawing figure, shows a preferred embodiment of the pneumatic drive unit according to the invention in a side sectional view.

A drive unit A shown in section in FIG. 1 is designed as a pneumatic diaphragm actuator and includes a first energy storage device including compression springs 10, a connection 14 for pneumatic auxiliary power, a diaphragm 22, a diaphragm plate 24 connected with diaphragm 22, and a drive rod 18 screwed to the diaphragm plate 24 by nuts 46 and 48.

All of these components are surrounded by a two-shell housing 36 through which a center drive rod 18 projects. The center drive rod 18 is mounted so that it can move up and down in the housing within bearing shells 33 and 35.

The drive rod 18 is associated with a second energy storage device including cup springs 12 and covered by a housing 38. The second energy storage device is retained during normal operation of the drive unit and irreversibly released when a maximum temperature is exceeded.

Retention is provided by a joint 26. This joint is part of a sleeve-shaped guide piece 34 that serves as a counterbearing and has a locking plate 37. A locking plate 32 likewise serves as a counterbearing. The locking plate 32 is mounted by its guide bushing 31 on a projecting outer envelope of guide element 34 that forms part of the first counterbearing. The guide element 34, in turn, is mounted on the bearing shell 35.

One counterbearing fits sleevewise into the other to form a joint 26 in the shape of a cylinder envelope in the area of their mutual contact. This joint is closed in the position shown, in which the cup springs that act as adjusting springs are held between the flanges of counterbearings 32 and 34 and compressed by locking plate 32 and flange 37 of the counterbearing. The joint 26 is closed by a soldered joint 27 by which the two counterbearings are nondisplaceably held in the position shown.

The drive rod guided in bearing shells 33 and 35 projects with its extension 40 beyond the nested sleeve-shaped counterbearings and thus beyond the locking plate 32. The drive rod 18 supports, at its end, a driving plate 30 that is secured by a screw connection or nut 49.

Joint 26 can separate above a maximum temperature during normal operation, as described above, so that the counterbearings are permanently connected to one another and the second energy storage device that comprises the actuating spring 12 is held under tension.

An indicator 28 in the form of a pointer fastened to the locking plate 32 of the second counterbearing projects visibly through a recess 39 in housing 38 and allows the second energy storage device to be monitored. The indicator 28 indicates whether the joint has separated or is in the correct pretensioned position during normal operation. Indicator 28, for example, can be sealed by a rubber bellows in recess 39 or can operate in another embodiment, with zero contact, without any recesses in the housing. If the pneumatic auxiliary energy fails at the connection 14, the compression springs urge the diaphragm plate 24 in known fashion so that the drive rod 18 in this embodiment is pressed downward into a safety position.

The second energy storage device including the cup springs 12 has no influence whatsoever during normal operation on the drive rod 18 since the lock described prevents the rod 18 from exerting a force on the extension 40 of the drive rod 18.

When a maximum temperature is exceeded, the lock embodied in joint 26 is released. The retaining force of the joint 26 is provided as a function of temperature in the connection by the solder joint 27. The size of the joint 26 is dimensioned to correspond to the force of the second energy storage device that must be controlled. Preferably, a ratio of the force of the second energy storage device to the area of the soldered connection on the order of about $10^1$ N/mm$^2$ is provided.

Above the maximum temperature, therefore, the retaining force of the solder is no longer sufficient to hold cup springs 12 so that their force, acting through locking plate 32, driving plate 30, and extension 40, counteracts compression springs 10 engaging the diaphragm plate. Since the second energy storage device has a greater force than the first energy storage device, the pneumatic drive unit assumes a second safety position that opposes the action of the force of the first energy storage device.

The maximum temperature can be adjusted easily and reliably by using special solder or solder alloys. However, adhesives such as acrylate, cyanoacrylate, epoxy resin and the like can be used for special applications as joining means 27 for temperature-dependent locking of second energy storage device 12.

The direction of action of the pneumatic adjusting force and its safety position can be reversed in known fashion, with the compression springs, diaphragm 22, and diaphragm plate being reversed and transposed on housing 36 of the pneumatic connection. For this purpose, an additional connection 16 that is normally closed is provided for the auxiliary energy. Accordingly, the second energy storage device can be modified as well, so as to change the direction of action of the cup springs 12. The compression springs shown can then be replaced by extension springs.

The pneumatic drive unit described is preferably used in lifters but can also be used as a pneumatic part-turn valve actuator. When the unit is designed as a part-turn valve actuator, changes are required in the rod coupling 20 or the drive rod 18, shown schematically. Since, in the case of a part-turn valve actuator, the travel of the diaphragm 22, of the plate 24 or of the piston of the plate is usually converted into a rotary motion by one or more connecting rods, there are other design possibilities for the second energy storage device such that it is located on the back of the connecting rod.

The invention is not limited to the embodiments described above but also includes all variations within the scope of the features of the invention disclosed. For example a bellows under pressure can also be used as an energy storage device.

We claim:

1. A pneumatically operable drive unit comprising:

an actuator, a first energy storage device for moving the actuator into a safety position upon failure of auxiliary energy that supplies a driving force, a second energy storage device in an operating connection with the actuator, a lock joint for keeping the second energy storage device ineffective during normal operation, the second energy storage device having a direction of action that is opposite the direction of action of the first energy storage device and a stored force that is greater than a force of the first energy storage device, and joint means for irreversible release of the lock joint when a predetermined maximum temperature is exceeded, thus moving the actuator into a second safety position.

2. The drive unit according to claim 1, wherein the first energy storage device includes return springs, the actuator includes a drive rod, and the second energy storage device is formed by adjusting springs, and further comprising:

first and second nested sleeve-shaped counterbearings secured in a compressed state during normal operation and holding the adjusting springs, and located coaxially with respect to the first energy storage device and the drive rod, return springs for implementing the first energy storage device, a driving plate facing the first counterbearing and permanently connected with an end of the driving rod facing the first counterbearing, the drive rod being urged by the adjusting springs against the direction of action of the return springs upon release of the lock joint, which is shaped as a cylinder envelope, under an influence of at least one of the counterbearings, and a first housing enclosing the drive unit on which the at least one of the counterbearings is supported.

3. The drive unit according to claim 2, wherein the lock joint shaped as a cylinder envelope is filled between nested sleeve-shaped counterbearings with a solder that has a predetermined melting point as said joint means.

4. The drive unit according to claim 2, wherein the adjusting springs are drive springs designed as cup springs and are surrounded by a second housing, said second housing, together with said first housing, permitting adjusting movements of the drive rod.

5. The drive unit according to claim 4, and further comprising an indicator operable by release of the lock joint.

6. The drive unit according to claim 5, wherein the indicator is designed as a pointer that projects through a second housing containing said adjusting springs, said indicator being permanently connected with at least one of the counterbearings that faces the end of an adjusting member.

7. The drive unit according to claim 5, wherein the actuator is a drive rod that axially penetrates the return and actuating springs, the actuating springs, associated counterbearings with the indicator, and the second housing forming a structural unit, said unit being connected with the first housing of a diaphragm drive on a side facing away from an outlet opening for the drive rod, and being traversed by an extension of the drive rod.

8. The drive unit according to claim 3, wherein the holding force of the lock joint is on an order of approximately $10^1$ N/mm$^2$ for a ratio of a spring force of the adjusting springs to a cylinder envelope surface of the solder connection between the counterbearings.

9. The drive unit according to claim 3, wherein the lock joint is formed by a projecting outer surface in the shape of a cylinder envelope of one of the sleeve-shaped counterbearings and a facing inner surface in a form of a cylindrical sleeve of an extension of a locking plate that serves as a second counterbearing, with a solder layer that is solid until a maximum temperature is reached being located between the sleeves, said solder layer connecting the two counterbearings together when it is solid.

10. The drive unit according to claim 3, wherein the adjusting springs are drive springs designed as cup springs and are surrounded by a second housing, said second housing, together with said first housing, permitting adjusting movements of the drive rod.

11. The drive unit according to claim 10, and further comprising an indicator operable by release of the lock joint.

12. The drive unit according to claim 11, wherein the indicator is designed as a pointer that projects through a second housing containing said adjusting springs, said indicator being permanently connected with at least one of the counterbearings that faces the end of an adjusting member.

13. The drive unit according to claim 11, wherein the actuator is a drive rod that axially penetrates the return and actuating springs, the actuating springs, associated counterbearings with the indicator, and the second housing forming a structural unit, said unit being connected with the first housing of a diaphragm drive on a side facing away from an outlet opening for the drive rod, and being traversed by an extension of the drive rod.

14. The drive unit according to claim 6, wherein the actuator is a drive rod that axially penetrates the return and actuating springs, the actuating springs, associated counterbearings with the indicator, and the second housing forming a structural unit, said unit being connected with the first housing of a diaphragm drive on a side facing away from an outlet opening for the drive rod, and being traversed by an extension of the drive rod.

15. The drive unit according to claim 4, wherein the lock joint is formed by a projecting outer surface in the shape of a cylinder envelope of one of the sleeve-shaped counterbearings and a facing inner surface in a form of a cylindrical sleeve of an extension of a locking plate that serves as a second counterbearing, with a solder layer that is solid until a maximum temperature is reached being located between the sleeves, said solder layer connecting the two counterbearings together when it is solid.

16. The drive unit according to claim 5, wherein the lock joint is formed by a projecting outer surface in the shape of a cylinder envelope of one of the sleeve-shaped counterbearings and a facing inner surface in a form of a cylindrical sleeve of an extension of a locking plate that serves as a second counterbearing, with a solder layer that is solid until a maximum temperature is reached being located between the sleeves, said solder layer connecting the two counterbearings together when it is solid.

17. The drive unit according to claim 6, wherein the lock joint is formed by a projecting outer surface in the shape of a cylinder envelope of one of the sleeve-shaped counterbearings and a facing inner surface in a form of a cylindrical sleeve of an extension of a locking plate that serves as a second counterbearing, with a solder layer that is solid until a maximum temperature is reached being located between the sleeves, said solder layer connecting the two counterbearings together when it is solid.

18. The drive unit according to claim 7, wherein the lock joint is formed by a projecting outer surface in the shape of a cylinder envelope of one of the sleeve-shaped counterbearings and a facing inner surface in a form of a cylindrical sleeve of an extension of a locking plate that serves as a second counterbearing, with a solder layer that is solid until a maximum temperature is reached being located between the sleeves, said solder layer connecting the two counterbearings together when it is solid.

19. The drive unit according to claim 8, wherein the lock joint is formed by a projecting outer surface in the shape of a cylinder envelope of one of the sleeve-shaped counterbearings and a facing inner surface in a form of a cylindrical sleeve of an extension of a locking plate that serves as a second counterbearing, with a solder layer that is solid until a maximum temperature is reached being located between the sleeves, said solder layer connecting the two counterbearings together when it is solid.

* * * * *